US006920942B2

(12) United States Patent
Koederitz

(10) Patent No.: US 6,920,942 B2
(45) Date of Patent: Jul. 26, 2005

(54) METHOD AND APPARATUS FOR DIRECTLY CONTROLLING PRESSURE AND POSITION ASSOCIATED WITH AN ADJUSTABLE CHOKE APPARATUS

(75) Inventor: William L. Koederitz, Cedar Park, TX (US)

(73) Assignee: Varco I/P, Inc., Houston, TX (US)

( * ) Notice: Subject to any disclaimer, the term of this patent is extended or adjusted under 35 U.S.C. 154(b) by 192 days.

(21) Appl. No.: 10/353,650

(22) Filed: Jan. 29, 2003

(65) Prior Publication Data

US 2004/0144565 A1 Jul. 29, 2004

(51) Int. Cl.[7] ..... E21B 21/08
(52) U.S. Cl. ..... 175/25; 175/38; 175/48
(58) Field of Search ..... 175/24, 25, 38, 175/90, 48

(56) References Cited

U.S. PATENT DOCUMENTS 3,362,487 A * 1/1968 Lindsey ..... 175/38
3,677,353 A * 7/1972 Baker ..... 175/25
3,906,726 A * 9/1975 Jameson ..... 60/327
3,971,926 A * 7/1976 Gau et al. ..... 708/3
4,138,669 A * 2/1979 Edison et al. ..... 340/3.51
4,595,343 A * 6/1986 Thompson et al. ..... 417/53
6,102,673 A * 8/2000 Mott et al. ..... 417/392
6,484,816 B1 * 11/2002 Koederitz ..... 175/25
2003/0168258 A1 * 9/2003 Koederitz ..... 175/38
2003/0196804 A1 * 10/2003 Riet ..... 166/267

OTHER PUBLICATIONS

Koederitz et al., Advanced Choke Control System for Underbalanced Drilling, IADC Underbalanced Drilling Conference & Exhibition, Oct. 27–28, 1999, 5 pages, 17 figures.

* cited by examiner

*Primary Examiner*—William Neuder
(74) *Attorney, Agent, or Firm*—Guy McClung

(57) ABSTRACT

A hybrid choke control system wherein the traditional choke experience is manifest in auditory and visual feedback mechanisms which are emulated by a digital control system enabling direct control of either position or back pressure associated with an adjustable choke device. The present invention enhances safety and efficiency when used in association with oil field drilling operations and in particular when applied to a device which provides the user with enhanced control capabilities for direction controlling the back pressure and position associated with drilling chokes during down hole operations.

20 Claims, 7 Drawing Sheets

KickMaster eChoke Console Detail

KickMaster eChoke Console Detail eChoke - Basic Configurations

FIG 6 Control Valve Schematic for eChoke with Hydraulically-Actuated Chokes

*User controls when in position-control mode:*

*User controls when in pressure-control mode:*

METHOD AND APPARATUS FOR DIRECTLY CONTROLLING PRESSURE AND POSITION ASSOCIATED WITH AN ADJUSTABLE CHOKE APPARATUS

BACKGROUND OF THE INVENTION

1. Field of the Invention

The present invention relates generally to oil field drilling operations and in particular to a method and apparatus that provides a user with enhanced control choke capabilities for directly controlling the pressure associated with and/or position of a choke element associated with a drilling choke during down hole operations.

2. Summary of the Related Art

There are many applications in which there is a need to control the backpressure of a fluid flowing in a system. For example, in the drilling of oil wells it is customary to suspend a drill pipe in the well bore with a bit on the lower end thereof and, as the bit is rotated, to circulate a drilling fluid, such as a drilling mud, down through the interior of the drill string, out through the bit, and up the annulus of the well bore to the surface. This fluid circulation is maintained for the purpose of removing cuttings from the well bore, for cooling the bit, and for maintaining hydrostatic pressure in the well bore to control formation gases and prevent blowouts, and the like. In those cases where the weight of the drilling mud is not sufficient to contain the bottom hole pressure in the well, it becomes necessary to apply additional backpressure on the drilling mud at the surface to compensate for the lack of hydrostatic head and thereby keep the well under control. Thus, in some instances, a backpressure control device is mounted in the return flow line for the drilling fluid.

Backpressure control devices are also necessary for controlling "kicks" in the system caused by the intrusion of salt water or formation gases into the drilling fluid, which may lead to a blowout condition. In these situations, sufficient additional backpressure must be imposed on the drilling fluid such that the formation fluid is contained and the well controlled until heavier fluid or mud can be circulated down the drill string and up the annulus to kill the well. It is also desirable to avoid the creation of excessive back pressures which could cause drill string to stick, or cause damage to the formation, the well casing, or the well head equipment.

However, maintenance of an optimum backpressure on the drilling fluid is complicated by variations in certain characteristics of the drilling fluid as it passes through the backpressure control device. For example, the density of the fluid can be altered by the introduction of debris or formation gases, and/or the temperature and volume of the fluid entering the control device can change. Therefore, the desired backpressure will not be achieved until appropriate changes have been made in the throttling of the drilling fluid in response to these changed conditions. Conventional devices generally require manual control of and adjustments to a choking device orifice to maintain the desired backpressure. However, manual control of the throttling device or choke involves a lag time and generally is inexact.

U.S. Pat. No. 4,355,784 (the '784 patent) discloses an apparatus and method for controlling backpressure of drilling fluid in the above environment, which addresses the problems set forth above. According to this arrangement, a balanced choke device moves in a housing to control the flow and the backpressure of the drilling fluid. One end of the choke device is exposed to the pressure of the drilling fluid and its other end is exposed to the pressure of a control fluid.

Conventional choke control systems are difficult to utilize accurately or efficiently and require a great deal of experience to operate properly. The typical conventional choke control mechanism comprises a needle valve to control the rate of hydraulic fluid flow and a direction lever for controlling the direction of an open/close valve in a choke device. For example, to make an adjustment to slowly increase the backpressure associated with a conventional choke, an operator shuts down the needle valve supplying hydraulic fluid to a hydraulically actuated choke to reduce supply of hydraulic fluid to a minimum so that the choke element moves slowly in the direction selected by the open/close valve. The operator relies on his experience in interpreting the familiar sounds and physical feedback associated with manipulating the choke controls. The operator relies on physical feed back during choke manipulation, that is, the resistance and vibration of the joystick and the sound of the air-over-hydraulic pump kicking in indicates to the operator that the choke control is engaged and operating. The operator looks at the backpressure and determines if the new desired back pressure was achieved. If the operator has overshot or undershot his pressure target, he similarly makes another adjustment using the open/close valve and the needle valve to adjust the choke until the desired backpressure is achieved. Proper adjustment of the choke element to achieve desired back pressure level is an iterative procedure typically requiring multiple attempts to achieve the desired result. This is a time consuming, inefficient and relatively inaccurate procedure for adjusting a choke. Thus, there is a need for method and apparatus for efficiently and accurately controlling a choke. There is also a need for a method and apparatus for directly controlling the position and back pressure associated with a choke device while maintaining the physical experience of traditional choke control methods to ensure proper operation by skilled operators experienced with conventional choke control methods. This method preferably is clear and straight-forward even to new (inexperienced) choke operators.

SUMMARY OF THE INVENTION

The present invention provides a hybrid choke control system wherein the traditional choke experience is manifest in physical auditory and visual feedback mechanisms which are emulated by an operator console associated with a digital control system enabling direct control of either position or back pressure associated with an adjustable choke device. The present invention enhances safety and efficiency when used in association with oil field drilling operations and in particular when applied to a device which provides the user with enhanced digital control capabilities for controlling the back pressure and position associated with drilling chokes during down hole operations. The present invention is described herein for use on drilling rigs, however, numerous other applications are intended for the present invention.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF A PREFERRED EMBODIMENT

The present invention is described herein by the following example for use on drilling rigs, however, numerous other applications are intended as appropriate for use in association with the present invention. In a preferred embodiment the present invention replaces conventional choke control methods and apparatuses with an improved digital choke control system that provides a more accurate and faster response choke control than prior systems while maintaining the look and feel of prior known choke control systems. The user adapts to perceive the present invention as the preferred manner of controlling the choke versus known conventional choke control methodologies and apparatuses. The present invention also enables direct control of both pressure and position associated with a choke.

The present invention is a replacement for any application requiring the use of a choke. Preferably the user relies on the conventional known choke control methods only as emergency manual backup stations used to back up the improved choke control method and apparatus provided by the present invention. It is expected that the user population will eventually develop enough familiarity and confidence in the choke controlling method and apparatus of the present invention that the user interface provided by the present invention will become the only choke-control-related component located on the rig floor. Eventually, it is expected that in order to simplify rig operations and create more space on the rig floor, that users will exclusively utilize the present invention to the exclusion of conventional choke control methodologies and conFig. rigs without conventional choke control equipment on the rig floor. That is, all conventional choke control equipment (such as choke console for hydraulic actuators, remote manual station for electric actuators, etc) will be either removed or initially omitted from a rig floor configuration design. It is expected that the drilling industry will eventually gravitate to the exclusive use of method and apparatus of the present invention as the only choke control function on the rig floor.

Figure 1:
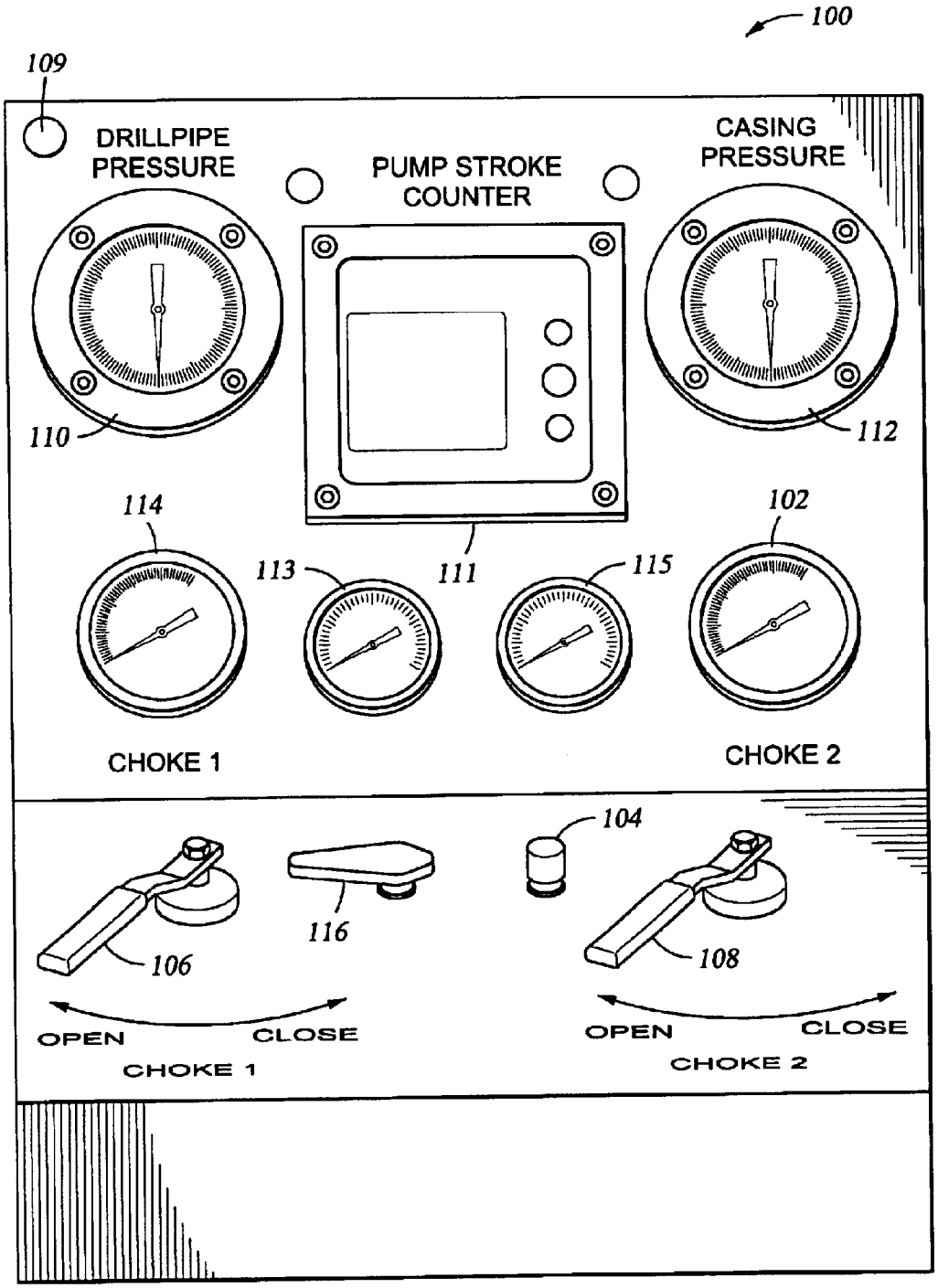
Fig. 1 (PRIOR ART)
FIG. 1 is an illustration of prior art choke control mechanism.

As shown in FIG. 1, conventional choke control mechanisms, known in the prior art comprise a console 100 and direction controls 106 and 108 for choke 1 and choke 2 respectively. Choke 1 has associated position readout dial 114 and choke 2 has associated position readout dial 102. The casing pressure is indicated by readout casing pressure gauge 112. The drill pipe pressure is indicated by drill pipe pressure read out gauge 110. Speed control is provided by needle valve 104. A pump stroke counter is provided by a central display 111.

Figure 2:
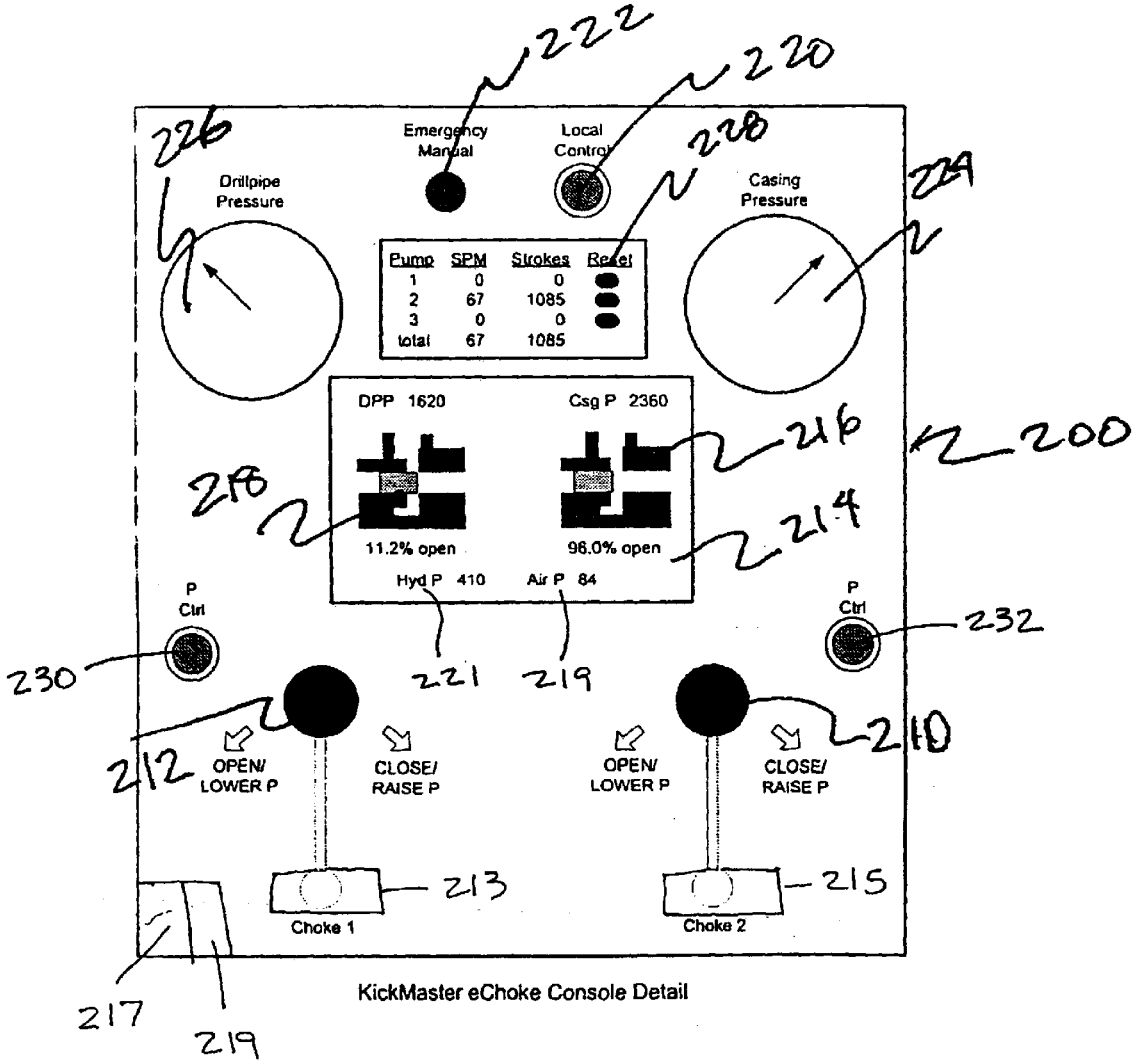
FIG. 2 is an illustration of a preferred embodiment of the improved choke mechanism operator interface.

The present invention replaces the choke control apparatus shown in FIG. 1. The improved choke control user interface is shown in FIG. 2. In general, the present invention controls both hydraulically and electrically actuated chokes. The control signals to the actuator may be open/close commands or position-set point commands or pressure set point commands, dependent on specific actuator capabilities and design decisions for the particular implementation or selection of features of the present invention. The preferred choke control operator station 200 or interface comprises choke control joysticks 212 and 210 for directly controlling either the position or the pressure for choke 1 and choke 2 respectively. Data display 214 generates operator visual feedback showing various instrument readings comprising a graphical display of choke 1 and its position 218 and choke 2 and its position 216. Casing pressure is shown in gauge 224. Drill pipe pressure is shown in gauge 226. Emergency Manual indicator 222, for example, a red light indicates to the operator when the Emergency Manual backup system has taken over from the digital operator choke controller interface 200. Local control light 220 indicates when this choke control operator interface 200 is in control and active in the choke control process. Multiple choke control operator stations 200 may be provided on a single oil rig. Processor 217 performs calculations shown in FIG. 5 and provides physical feedback via a sound generator 219 and variable resistance to joy stick 212 and 210 via variable resistance mechanical interface 213 and 215 respectively.

Figure 3:
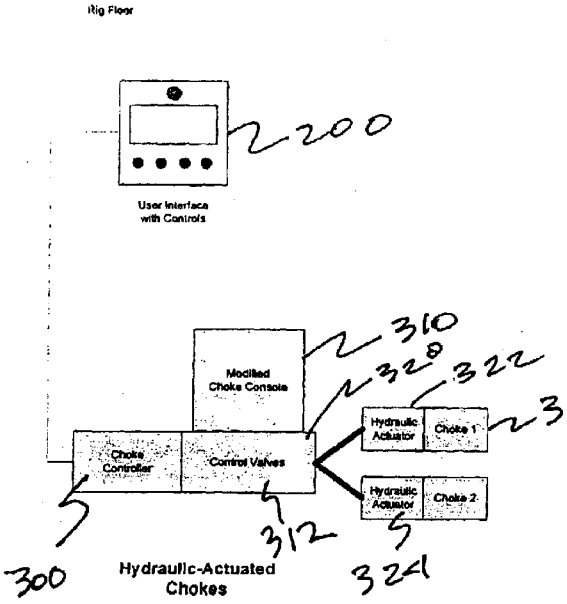
FIG. 3 is an illustration of a preferred system showing the preferred operator interface and hydraulic-actuated choke control system.

As shown in FIG. 3, the Digital Operator Control interface 200 and Choke Control System 300 of the present invention work together to control the choke. Choke Control System 300 takes inputs from the Digital Operator Control interface 200 and sends control commands to control valves 312 in association with modified choke console 310. The control valves module 312 controls flow of hydraulic fluid to hydraulic actuator 322 for choke 1 and hydraulic actuator 324 for choke 2.

Figure 4:
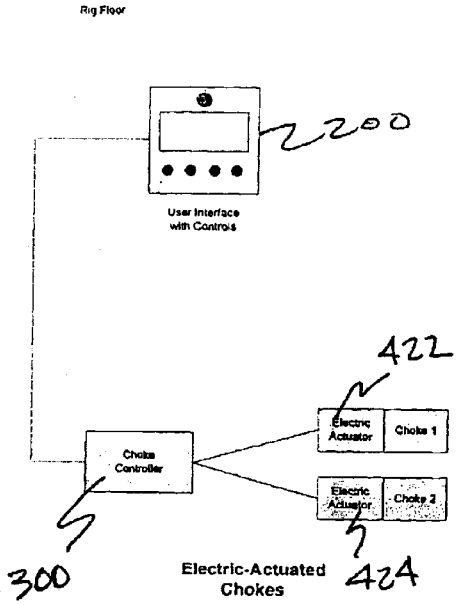
FIG. 4 is an illustration of a preferred system showing the preferred operator interface and electric-actuated choke control system.

As shown in FIG. 4, the Digital Operator Control interface 200 and Choke Control System 300 of the present invention work together to control the choke. Choke Control System 300 takes inputs from the Digital Operator Control interface 200 and sends control commands to electric actuator 422 for choke 1 and electric actuator 424 for choke 2.

Figure 5:
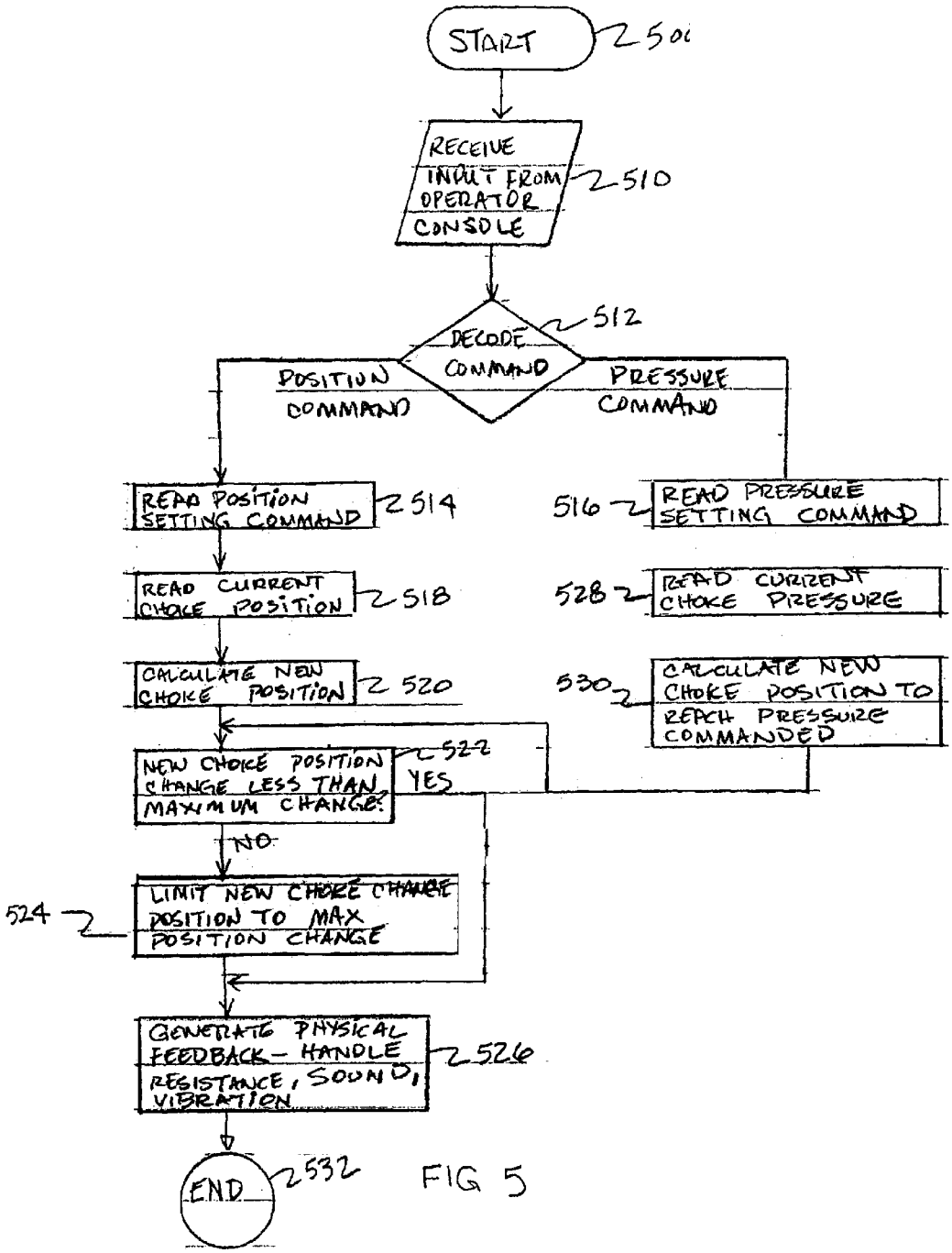
FIG. 5 is a flow chart illustrating the control steps taken by the present invention during a choke control operation.

FIG. 5 illustrates a process flow chart for receiving inputs from an operator an controlling either the position or pressure directly.

Figure 6:
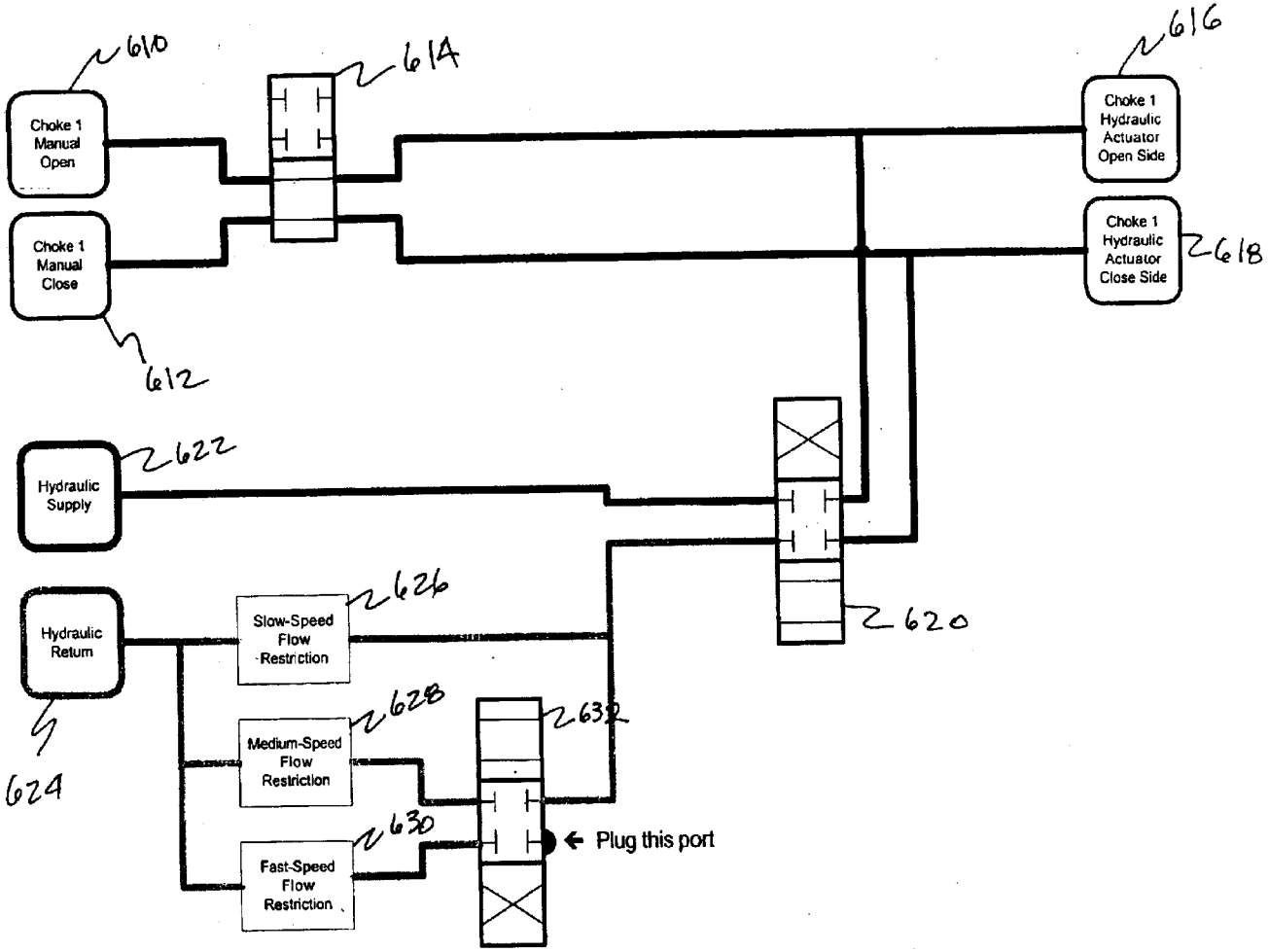
FIG. 6 is an illustration of a control valve schematic with hydraulically-actuated chokes.

FIG. 6 illustrates a control valve schematic for hydraulically actuated chokes. Choke control emergency manual backup open 610 and emergency manual backup close 612 interface with control valve 614 to operate choke hydraulic actuator open side 616 and choke hydraulic actuator close side 618. Hydraulic supply 622 interfaces with directional control valve 620 which controls flow of hydraulic fluid to operate choke hydraulic actuator open side 616 and choke hydraulic actuator close side 618. Hydraulic return 624 interfaces with slow speed flow restriction 626, medium speed flow restriction 628 and fast speed flow restriction 630. Valve 632 interfaces with valve 620 and, function restrictions 626, 628 and 630 to provide speed control for choke movement.

Figure 7:
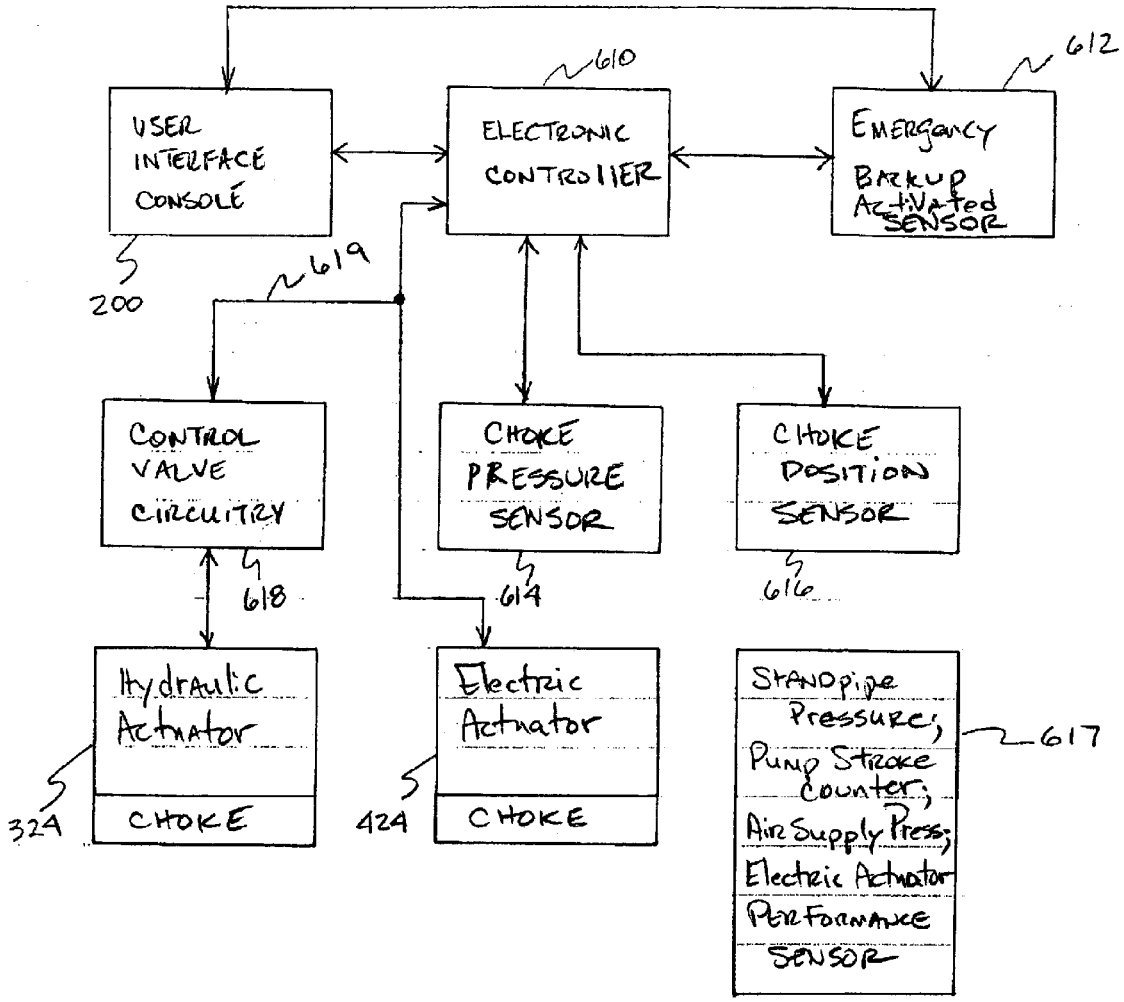
FIG. 7 is an illustration of the general components of the present invention.

FIG. 7 is an illustration of the general components of the present invention. The general components of the present invention comprise user interface 200, electronic controller 610, emergency backup activated sensor 612, control valve circuitry 618, hydraulic actuator 324, electric actuator 424, choke pressure sensor 614, control output signals 619, choke position sensor 616, and sensors 617 stand pipe pressure, pump stroke count, hydraulic supply pressure, air supply pressure and electric actuator performance. The control valve circuitry 618 is provided to control hydraulic fluid flow to the actuator; thereby controlling the direction of flow (open/close routing) and rate of flow.

Examples of choke/actuator combinations supported by the present invention comprise: M/D Totco drilling choke with hydraulic actuator; Power drilling choke with worm-gear hydraulic actuator; and Chimo Willis choke with electric actuator, with either open/close or position-set point actuator controller (integral to actuator). The present invention is extendable to virtually any other choke/actuator combination.

The present invention provides for the control of a variety of remotely-actuated drilling chokes. The quality and presentation of the overall design is preferably consistent with different choke mechanisms and thus will not be intentionally reduced by the constraints of any specific actuator or choke as the control methods and apparatus provided by the present invention are independent of actuation methods and choke performance curves. Preferably a consistent user view is provided to maintain intuitive operation between configurations provided for the various choke mechanisms.

For hydraulic-actuated chokes, the present invention provides an interface with existing actuators and choke consoles, with following functions provided at the user's console: Quick-connects for pressurized hydraulic supply and return lines for quick retrofitting of the present invention into existing choke installations; Emergency Manual Backup button and a "Station in Control" indicator light. As discussed below, the operator interface comprises aural, visual and physical feedback to the user in a simulation of traditional choke control methodologies.

For electric-actuated chokes, the present invention provides an interface with the existing actuators and choke consoles, with following functions added to console: Interface and electrical devices as needed to interface with specific actuator comprising, for example, the Emergency Manual Backup functionality as implemented in present invention.

The base configuration for the preferred embodiment of the present invention comprises Dual chokes; Position- and pressure-set control; a "Full choke console" integrated display; and a User interface connected to controller with wires.

The initial list of configuration options for the present invention preferably comprises: Inclusion of each actuator/choke combination on the supported list; Single choke only; Position-set control only; Limited display; High-availability system; Additional user interface stations; Wireless user interface station and wireless controller. The present invention provides an emergency manual backup method and apparatus, which includes the traditional choke control methodologies with which the users are intuitively and extensively familiar. Thus, operator's wealth of experience and expertise are not diminished by introduction of a new product with which they have no experience and would have to traverse a possibly steep and costly learning curve. The present invention looks and feels and sounds like the conventional choke control device with which they are familiar. All currently known pressure control techniques are usable with present invention. The currently-known choke control methods are available for inclusion, if desired, as an emergency manual backup method and apparatus.

The activation of the emergency manual backup method of control will be initiated at the emergency manual control station located off the rig floor. When the emergency manual backup method is activated, notice of this activation becomes evident at the operators console 200 via a perceptible aural, visual or physical operator notification signal at the console as part of the user interface for the present invention, such as 222. When the emergency manual backup is activated, it takes over through the emergency manual backup user interface and the control functionality of the present invention user interface will be disabled.

In a preferred embodiment, a duplicate display of the operator console 200 lights on the rig floor choke control console 220 and 222 is provided at the emergency manual back up console to inform the user via the emergency manual back up console user interface and show the activation state of the emergency manual backup on a separate display at the emergency manual backup station.

The preferred typical arrangement for the present invention provides a user interface on the rig floor and all other components are located near the actual chokes. An alternative arrangement is provided to accommodate cases wherein a user customer prefers a different arrangement examples are initial introduction or initial use of present invention on critical well conditions. The present invention is compatible with locating an alternate and already accepted control method on the rig floor. Typically, for hydraulic-actuated chokes this would be the choke console, and for electric-actuated chokes this would be a remote open/close control station.

All of the functionality of the present invention, except for the pressure-set control mode, is easily usable by any choke operator with previous experience on a conventional choke with the same type of actuation (e.g. hydraulic or electric). The pressure-set control mode functionality is easily usable by a similarly-experienced choke operator after a brief (i.e. less than 15 minutes) introductory training period, which might be a video, a rig-site simulator, a web-based introduction, exposure in a well control school, hands-on training by service personnel, etc.

The present invention provides physical user controls (such as joysticks, buttons, etc.) in all cases where there is extensive or high frequency use of the control. The simulation of the traditional choke control experience bolsters user confidence at it provides an experience close to if not identical to existing choke control methods. The emulation of traditional methods provided by the present invention enables experienced operators to operate the choke control method and apparatus of the present invention by feel, that is, without looking at the controls. In an alternative embodiment, other types of controls are provided, such as graphical touch screen controls and membrane-type buttons.

A neural network is provided and trained to learn the conventional choke control method and physical feedback associated therewith. The neural network can reproduce physical feedback given a set of operational parameters.

The present invention provides all user controls, regardless of type, designed for maximum usability. The control choices and how to execute them are evident and unambiguously clear. Conventional physical feedback is provided for all operator actions and system actions which enable presentation of an intelligible conceptual model with which the operator is familiar.

Both types of control functionality (i.e., position-set and pressure-set control) are provided to the user as discrete and as continuous actions. A discrete action is provided in response to a single crisp user action, for example, pressing a button or pressing and releasing a button or moving a joystick to a specific position. A continuous action is provided when a user maintains a control in one state, for example, holding a button down or maintaining a joystick within a specific position range. The continuous control action is carried out on a regular basis, which is managed by the user. Accelerating-type continuous control actions are not allowed by the present invention and are overridden by the processor 217. Both types of control actions are provided to the user in a three-value range (example—small/medium/large magnitudes of change).

The position-control functionality is provided to the user in the form of relative position movements in the open and closed directions. For example, the values offered may be 0.1%, 1% and 10% change in the position of the choke element inside of the choke. The new position set point is computed using the relative position increment and the current position. Thus, the position set point is not allowed to "race ahead" to values far from the current position.

The relative position increment is initially fixed for all chokes and actuators. The present invention enables tuning the relative position increment to the specific choke characteristics (loosely), the benefits of which would include increased operator convenience and improved control performance.

When the pressure control mode is selected, the pressure set point will be set to measured choke pressure. The user will be offered the opportunity to raise or lower the pressure set point by a selected pressure increment. For example, the range of pressure set point change values offered may be 25 psi, 100 psi and 500 psi. The new pressure set point is computed using the relative pressure increment and the current pressure. Thus, the pressure set point is not allowed to "race ahead" to values far from the current pressure.

In a preferred embodiment, the pressure set point value is visible to the user, however, knowledge of the pressure set point value is not in any way required to operate the pressure-set point control mode, just as a driver can operate a car with cruise control and never sees the speed set point value.

Any set of control set point incremental change values (whether position or pressure) offered to the user (i.e. the three-value ranges noted above) are limited to values which are within the measurable and controllable limits of the specific configuration of equipment of the present invention.

The present invention provides emulation-enhanced dual controls so that the user should be able to use the same control to operate with either control mode, and the operation of the control is consistent with the user's previous choke control experience. Preferably, the experience of operating the controls associated with the choke element movement is consistent between both control modes. For example, closing the choke in position-set control mode and raising the pressure set point in pressure-set control require similar control actuation movements and produce a similar physical experience for the operator.

When the user is in a given control mode provided by the present invention, either position-set point or pressure-set point control mode, the control device provides the user suitable physical feedback so that he can continue to exercise control based on physical feedback without looking at the control device. The control device provides an emulation of the traditional choke control experience with sufficient tactile, aural, visual and/or physical feedback of sufficiently obvious orientation such that at any time the choke control operator can tell where the current control command is and how to select other commands based solely on the perceived feedback or feel from the emulation of the traditional choke control experience associated with the control device. Preferably this experience is provided by a physical simulation or emulation of the conventional choke control experience, so that the controls look, sound and feel comfortable and familiar much like the conventional choke control experience. Simulating the conventional choke control experience enhances the safety of an operation while increasing an operator's ability to effectively operate the improved choke control method and apparatus of the present invention and avail himself of its benefits.

A preferred embodiment of the present invention comprises sensors for the items shown in Table 1.

TABLE 1

| Actuation Method | The present invention Base Configuration |
|---|---|
| | Choke pressure |
| | Choke 1 position |
| | Choke 2 position |
| | Standpipe pressure |
| | Pump stroke counter(s) - number of mud pumps? |
| | Emergency manual switch state |
| Hydraulic only | Hydraulic supply pressure |
| Hydraulic only | Air supply pressure |
| Electric only | Electric actuator performance indicator(s) |

The electric actuator performance indicator(s) are any data items that provide insight into the state and proper operation of the actuator, comprising, but not limited to, torque, temperature, current and supply of power to an actuator. Note that sensors may not be required for all of the listed inputs. For example, an electric actuator may provide position feedback via an analog output current or a network-communicated data value. The user interface displays data to the user and provides and offers control actions.

The activation state of the emergency manual backup method and apparatus of the present invention control state will be displayed in a manner that is easily perceptible from across the rig floor. In a preferred embodiment, a light and sound meter are provided to determine whether and what level of a light or sound notification to the operator is appropriate but must be available over 100 decibels. For example, if the noise level at the rig is below a set level, for example 100 decibels, then an aural notification signal is appropriate. Otherwise the aural notification may be swamped with ambient noise and become imperceptible to the operator. At any given time, one of these states must be true and the other false. The emergency manual backup activation state of true will be a red light and when appropriate, an aural notification. The present invention control state of true will be a green light and when appropriate, an aural notification.

The use of a yellow light and associated aural notification to show if a given station has control is also provided. The notification light states are as follows: Red—emergency manual backup method is active; Yellow—the present invention control is active, but this station is not in control; and Green—the present invention control is active, and this station is in control. An operator interface enables a station to take control, for example, when any control-related operator input occurs.

The following data will be displayed in a text format at the rig floor console: All of the sensor inputs, except for emergency manual switch state and pump stroke counter; Control mode state in effect (position-set point or pressure-set point); Pump speed(s) in strokes per minute (SPM); Cumulative pump stroke count; and Pressure set point value, when a pressure-set point control is in effect.

Graphical display of selected data is also provided. As shown in FIG. 2, graphical displays comprise a picture of the choke element and seat, showing the choke element position and speed/direction of movement of element; a trace of the choke pressure, with pressure set point displayed when in pressure-control mode; and gauges displaying pressure(s). The design of the data display provides a balance between showing data in task-specific groups (i.e. more screens) and simplicity (i.e. fewer screens) which comprises multiple screens, or screen layouts, which adjust to the task. The user is provided with controls for following input items: Selection of control mode; Selection of control command; Selection of display variations (if any); and Zero cumulative pump stroke count, for each pump.

The present invention user interface provides aural, physical and visual feedback for movement of the choke element. This feedback comprises an emulated sound similar to the traditional sound of the current air-over-hydraulic pump and electric actuator, as appropriate, or can be a new sound, such as a clicking. The sound will alert the user to the smallest detectable movement of the choke element. The sound is preferably expressive for any movement, as the sound also communicates the relative speed of movement of the choke element. The user will be able to adjust the volume of the sound at the user interface, from silent to loud (easily audible within 5 feet of the user interface with typical rig floor background noise). The emulated sound will be heard sooner than the sound it emulates and thus provides a rapid and more accurate means for enabling the operator to determine when the choke element is moving and to enhance operator's experience (knowledge) by building an enhanced mental model of choke movement.

In a conventional choke control system, the operator issues a command to move the choke element, the choke element moves and the air-over-hydraulic pump starts up to build up hydraulic pressure diminished by the choke element movement. The operator uses the sound of the air-over-hydraulic pump starting up to confirm that the choke element has moved. Thus, there is a feed back delay in the conventional system, that is, there is a delay between the time that the choke element moves and the time the air-over-hydraulic pump starts up and the operator hears the sound of the pump. In the preferred embodiment of the present invention, the emulated sound of the air-over-hydraulic pump starts up immediately when the operator moves the choke control joystick without the physical feedback delay encountered by operators in conventional choke control systems. Thus, in a preferred embodiment of the present invention, the operator receives immediate aural feedback that the choke control command is being executed by the choke control system.

The control performance of the present invention is more accurate and quicker than the best control performance attainable by an expert operator under similar flow conditions using the conventional known choke control equipment. The present invention enables an operator to rapidly, accurately and directly control the pressure drop across a choke. One evaluation of the control performance of the present invention is a set of pre-defined control exercises, which are repeatable and can be performed by a human operator with current equipment and a human operator utilizing the present invention. Examples of these exercises are: Starting at a given position, on command move the choke to different relative positions; and Starting at a given pressure and maintaining a fixed flow rate through the choke, change the pressure to different values.

The schedule of positions and pressures in the pre-defined control exercises covers a range of typical operations, such as small changes and large changes, and with the choke element at various initial control positions. The schedule rigorously challenges the capabilities of the human operator, the present invention, the actuator and the choke, within the allowable physical limits of the operational scenario. The evaluation system prompts the human operator at a console user interface provided by the present invention. Voice operator notifications are preferable for delivering the commands.

Installation of the present invention requires a minimum of tuning/calibration. The tuning/calibration procedure is easily understandable and unambiguous to any qualified service person. A confirmation procedure is provided, in which the service person verifies that the present invention is properly installed and meets all performance requirements. The service person documents the quality of the installation. The verification procedure is automatic and self-documenting. Once the present invention is installed and working properly, there will be no tuning requirements of any kind, nor will any user adjustments be required to maintain high quality control performance over any well conditions encountered.

The present invention provides a user interface preferably mounted to existing rig floor structure and also provides a pedestal mount with adjustable height, for convenient choke operation. A wireless version is also provided.

The present invention supports real-time two-way data communication, e.g., with Varco International, Inc.'s RigSense and DAQ JVM, and with other commercially available information systems. Preferably any sensors whose data is used by the present invention (for control and/or display) are directly connected to the present invention.

Preferably, when RigSense is present in a preferred embodiment, RigSerise provides data archiving and expanded data displays functionality to the present invention. The present invention provides a user interface integrated into other systems such as RigSense, DAQJVM and VICIS; Real-Time Well Control, supervisory control specific to well control tasks; and Automated well control, which may be entire process or selected sub-tasks. One of the primary impacts perceived on existing products and services in which integration and/or implementation of the present invention is performed is additional capability for taking control of and/or being in control of the choking operation via a distinct intervention, so that control is clearly being exercised by users at other stations and by automated controllers.

A key factor for efficient utilization and integration of the present invention into the operator's working environment is the present invention provision of manual controls for high-frequency user control actions in lieu of touch screen control consoles. Additional automated functionality is provided such as automatic pressure-set control for use in association with the touch screen and provides benefit in the control area, particularly in emergency stations.

Figure 8:
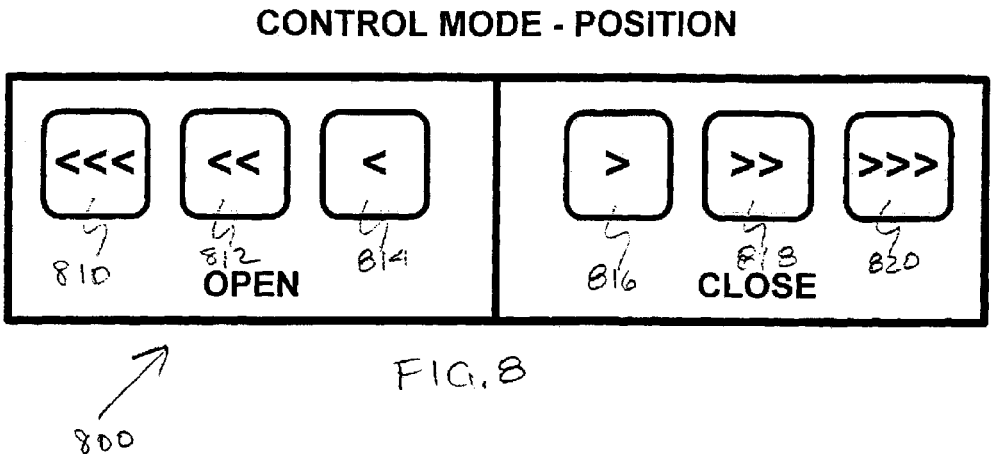
FIG. 8 is an illustration of a touch screen display for a preferred embodiment of the present invention.

Turning now to FIG. 8 in an alternative embodiment a touch screen user interface 800 is provided. As shown in FIG. 8, the touch screen control mode operator interface preferably comprises control touch pads 810, 812 and 814 for large, medium and small incremental movement of the choke control element in the open direction respectively. Control touch pads 820, 818 and 816 provide large, medium and small incremental movement of the choke control element in the close direction.

Figure 9:
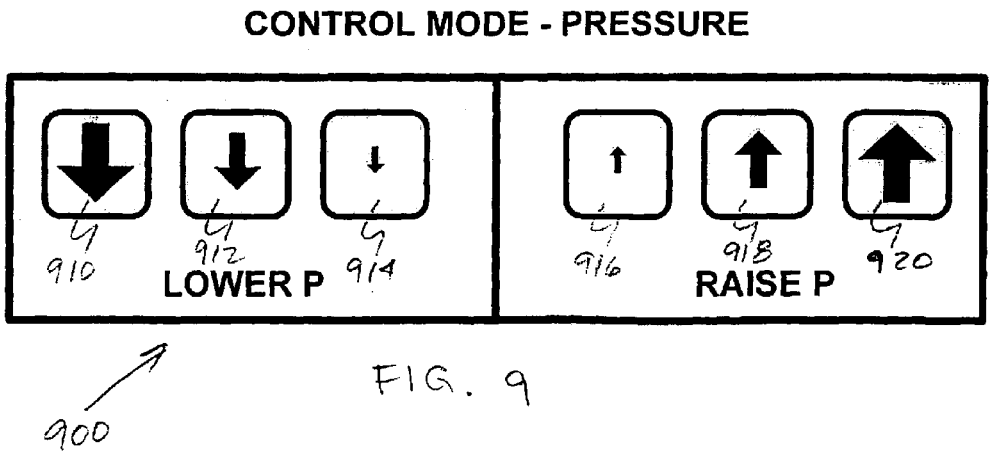
FIG. 9 is an illustration of a touch screen display for a preferred embodiment of the present invention

Turning now to FIG. 9, in an alternative embodiment a touch screen user interface 900 is provided for controlling the pressure associated with the choke element position. Touch pads 910, 912, and 914 are provided for incremental lowering of the pressure in large, medium and small increments, respectively. Touch pads 920, 918, and 916 are provided for incremental raising of the pressure in large, medium and small increments, respectively. Aural and visual feedback as described above are provided in association with operation of the touch screen interface of FIG. 8 and FIG. 9.

In another embodiment, the present invention is implemented as a set of instructions on a computer readable medium, comprising ROM, RAM, CD ROM, Flash or any other computer readable medium, now known or unknown that when executed cause a computer to implement the method of the present invention.

While the foregoing disclosure is directed to the preferred embodiments of the invention various modifications will be apparent to those skilled in the art. It is intended that all variations within the scope and spirit of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

What is claimed is:

1. A method for controlling a choke for controlling the back pressure for fluid flowing in an oil rig comprising:

receiving a choke control command from an operator console;

providing a control command to a choke device;

providing physical feed back to an operator indicating that the choke command has been executed; and receiving command input from a joystick.

2. The method of claim 1, further comprising:

receiving a choke element command from an operator console;

providing a choke element position command to the choke device; and providing physical feed back to the operator indicating that the choke position has changed.

3. The method of claim 2 further comprising:

receiving a restricted relative position choke element control command; and calculating the movement of the choke element based on the restricted relative position control command and a current position of the choke element so that the choke element position does not race ahead of its current position to a position far from its current location.

4. The method of claim 3, further comprising:

receiving a choke element direction command.

5. The method of claim 1 further comprising:

receiving a choke pressure control command;

sensing a current pressure of the choke device; and calculating the movement of the choke element based on the choke pressure control command and the current pressure of the choke element so that the choke element does not race ahead of its current pressure to a pressure far from its current pressure.

6. The method of claim 5, further comprising:

providing physical feedback to an operator indicating that choke pressure command has been executed.

7. A method for controlling a choke for controlling the back pressure for fluid flowing in an oil rig comprising:

receiving a choke control command from an operator console;

providing a control command to a choke device;

providing physical feed back to an operator indicating that the choke command has been executed;

receiving a choke element command from an operator console; providing a choke element position command to the choke device;

providing physical feed back to the operator indicating that the choke position has changed;

receiving a restricted relative position choke element control command; and calculating the movement of the choke element based on the restricted relative position control command and a current position of the choke element so that the choke element position does not race ahead of its current position to a position far from its current location.

8. An apparatus for controlling a choke element associated with an oil rig comprising a choke element adapted for movement in a choke housing to control the flow of fluid from an inlet passage to an outlet passage, the fluid applying a force on one end of the choke element;

an operator console for providing a choke control command;

a receiver for receiving the choke control signal from the operator console;

an operator console device for providing physical feed back to an operator indicating that the choke command has been executed;

a receiver for receiving a position choke element control command;

a sensor for sensing the current position of the choke element;

and a processor for calculating the movement of the choke element based on the choke control command and the position of the choke element so that the choke element does not race ahead of its current position to a position far from its current location.

9. The apparatus of claim 8, further comprising:

a sensor for sensing a position of the choke element in the choke device.

10. The apparatus of claim 8 further comprising:

a receiver for receiving choke pressure control command;

a sensor for sensing the current pressure of the choke device; and a processor for calculating the movement of the choke element based on the choke pressure control command and the current pressure of the choke element so that the choke element does not race ahead of its current pressure to a pressure far from its current pressure.

11. The apparatus of claim 8, further comprising:

a joystick for providing commands input to the choke controller.

12. An apparatus for controlling a choke element associated with an oil rig comprising:

a choke element adapted for movement in a choke housing to control the flow of fluid from an inlet passage to an outlet passage, the fluid applying a force on one end of the choke element;

an operator console for providing a choke control command;

a receiver for receiving the choke control signal from the operator console;

an operator console device for providing physical feed back to an operator indicating that the choke command has been executed;

a receiver for receiving choke pressure control command;

a sensor for sensing the current pressure of the choke device; and a processor for calculating the movement of the choke element based on the choke pressure control command and the current pressure of the choke element so that the choke element does not race ahead of its current pressure to a pressure far from its current pressure.

13. An apparatus for controlling a choke element associated with an oil rig comprising:

a choke element adapted for movement in a choke housing to control the flow of fluid from an inlet passage to an outlet passage, the fluid applying a force on one end of the choke element;

an operator console for providing a choke control command;

a receiver for receiving the choke control signal from the operator console;

an operator console device for providing physical feed back to an operator indicating that the choke command has been executed; and a joystick for providing commands input to the choke controller.

14. A computer readable medium containing computer executable instruction for performing a method for controlling a choke for controlling the back pressure for fluid flowing in an oil rig comprising:

receiving a choke control command from an operator console;

providing a control command to a choke device;

providing physical feed back to an operator indicating that the choke command has been executed;

receiving a choke element command from an operator console;

providing a choke element position command to the choke device;

providing physical feed back to the operator indicating that the choke position has changed;

receiving a restricted relative position choke element control command; and calculating the movement of the choke element based on the restricted relative position control command and a current position of the choke element so that the choke element position does not race ahead of its current position to a position far from its current location.

15. The medium of claim 14, further comprising:

receiving a choke element direction command.

16. The medium of claim 14 further comprising:

receiving a choke pressure control command;

sensing a current pressure of the choke device; and calculating the movement of the choke element based on the choke pressure control command and the current pressure of the choke element so that the choke element does not race ahead of its current pressure to a pressure far from its current pressure.

17. The medium of claim 16, further comprising:

providing physical feedback to an operator indicating that choke pressure command has been executed.

18. The medium of claim 14 further comprising:

receiving command input from a joystick.

19. A computer readable medium containing computer executable instruction for performing a method for controlling a choke for controlling the back pressure for fluid flowing in an oil rig comprising:

receiving a choke control command from an operator console;

providing a control command to a choke device;

providing physical feed back to an operator indicating that the choke command has been executed;

receiving a choke pressure control command;

sensing a current pressure of the choke device; and calculating the movement of the choke element based on the choke pressure control command and the current pressure of the choke element so that the choke element does not race ahead of its current pressure to a pressure far from its current pressure.

20. A computer readable medium containing computer executable instruction for performing a method for controlling a choke for controlling the back pressure for fluid flowing in an oil rig comprising:

receiving a choke control command from an operator console;

providing a control command to a choke device;

providing physical feed back to an operator indicating that the choke command has been executed; and receiving command input from a joystick.

* * * * *